United States Patent [19]

Baxter

[11] 4,348,010

[45] Sep. 7, 1982

[54] MOTORCYCLE JACK

[76] Inventor: David H. Baxter, 3049 N. 52nd Pkwy., Phoenix, Ariz. 85031

[21] Appl. No.: 207,231

[22] Filed: Nov. 17, 1980

[51] Int. Cl.[3] ..... B66F 7/22

[52] U.S. Cl. ..... 254/131

[58] Field of Search ..... 254/120, 131, 8 R, 94, 254/1; 414/447; 280/293; 211/22, 17; 248/352

[56] References Cited

U.S. PATENT DOCUMENTS 3,667,728 6/1972 Garelick ..... 414/447

4,113,235 9/1978 Hartman ..... 254/131

4,180,253 12/1979 Ivers et al. ..... 254/131

*Primary Examiner*—Robert C. Watson

*Attorney, Agent, or Firm*—Don J. Flickinger

[57] ABSTRACT

A frame has an upper edge for bearing against the underside of a motorcycle and a lower edge for bearing upon the ground. The frame is rotated about the lower edge from a substantially horizontal position to an upright position for lifting and supporting a selected end of the motorcycle.

6 Claims, 7 Drawing Figures

MOTORCYCLE JACK

FIELD OF THE INVENTION

This invention relates to lifting devices.

In a further aspect, the instant invention relates to jacking devices for vehicles.

More particularly, the instant invention concerns a jack for lifting and supporting a selected wheel of a two wheeled vehicle, such as a motorcycle.

PRIOR ART

The prior art is replete with various lifting and supporting devices especially adapted for use in connection with vehicles. Commonly referred to as jacks, the devices range in size from large, permanent implacements to relatively small, portable units. Exemplary are powered lifts commonly found in service and repair facilities and emergency jacks conveniently stowable in the luggage compartment of automobiles. Also known are intermediate sized semi-portable units referred to as floor jacks.

The devices are operable by various means. Lifts are generally powered by pneumatics. Floor jacks are frequently manually actuated hydraulic units. Small portable jacks are commonly either mechanical or hydraulic. Lead screws and rachets are common mechanical actuating mechanisms.

The foregoing prior art devices are especially adapted for use in connection with vehicles having four wheels, such as automobiles and trucks. Lifts usually elevate the entire vehicle. Floor jacks are capable of elevating a selected end or side, including two wheels, of a vehicle. Portable units most commonly are used to raise a selected wheel.

A primary utility of floor jacks and portable jacks is the lifting of one wheel of the vehicle while changing a tire or performing other wheel connected repairs. It is obvious that during the raising of one or two wheels, by the above single point lifting devices, the other two or three wheels remain upon the ground. Therefore, the use of jacks is dependent upon the nonraised wheels to provide stability by means of at least a three point contact with the ground.

Devices of the foregoing type, however, are not suitable for lifting one wheel of a two wheel vehicle such as a motorcycle. Elevating one wheel by a single point lifting device would result in a totally unstable two point contact with the ground. Further, the ground clearance of the frame intermediate the wheels is sufficiently low to prohibit the use of a conventional jack, even if an auxiliary stabilizing device were available. For the foregoing and other reason, jacks available at the present time have proven to be unacceptable for use with two wheeled vehicles.

It is apparent that the prior art has not particularly addressed the need for a jack or lifting device especially adapted for elevating one wheel of a two wheeled vehicle. It would be highly advantageous, therefore, to remedy the deficiencies inherent in the prior art.

Accordingly, it is an object of the present invention to provide a jack for two wheeled vehicles.

Another object of the invention is the provision of a device for elevating one wheel of a motorcycle.

Another object of the invention is to provide a jack which will stablily support a motorcycle in a position in which only one of the wheels is in ground contact.

Still another object of the invention is the provision of a motorcycle jack which is relatively lightweight and substantially portable.

Yet another object of the invention is to provide a motorcycle jack which is not readily subject to tipping or allowing the load to fall.

Yet still another object of the invention is the provision of a jack which is unencumbered and exceedingly simple to operate.

And a further object of the invention is to provide a jack which is rigidly constructed for maximum service life with minimal maintenance.

Still a further object of the immediate invention is the provision of a jack which is adapted to be alternately shaped and dimensioned for compatibility with variously configured vehicles.

Yet a further object of the invention is to provide a device which is operable to selectively raise either wheel of a motorcycle.

And yet a further object of the invention is the provision of a jack according to the above which is relatively simple and inexpensive to manufacture.

SUMMARY OF THE INVENTION

Briefly, to achieve the desired objects of the instant invention in accordance with a preferred embodiment thereof, first provided is a rigid lifting member having a lower edge for bearing upon the ground and an upper edge for bearing against the frame of a motorcycle intermediate the wheels thereof. The edges are spaced apart a greater distance than the distance between the frame and the ground or any other suitable substantially planar supporting surface. Next provided are lever means for rotating the lifting member about the lower edge between a substantially horizontal position resting upon the ground below the frame and a substantially upright position for elevating and supporting the motorcycle.

In accordance with a further embodiment of the invention, the lifting member is in a form of a generally rectangular frame having a foot extending along the lower edge thereof for increasing the bearing surface upon the ground, and for providing a fulcrum for rotating the lifting member. The lever means comprises an elongate handle extending from the lifting member at a point nearer the upper surface than the lower surface. A recess may be formed in the upper edge of the lifting member to accommodate any appendage, such as muffler, of the motorcycle which normally depends below the frame.

BRIEF DESCRIPTION OF THE DRAWINGS

The foregoing and further and more specific objects and advantages of the instant invention will become readily apparent to those skilled in the art from the following detailed description of preferred embodiments thereof, taken in conjunction with the drawings, in which.

DESCRIPTION OF THE PREFERRED EMBODIMENTS

Figure 1:
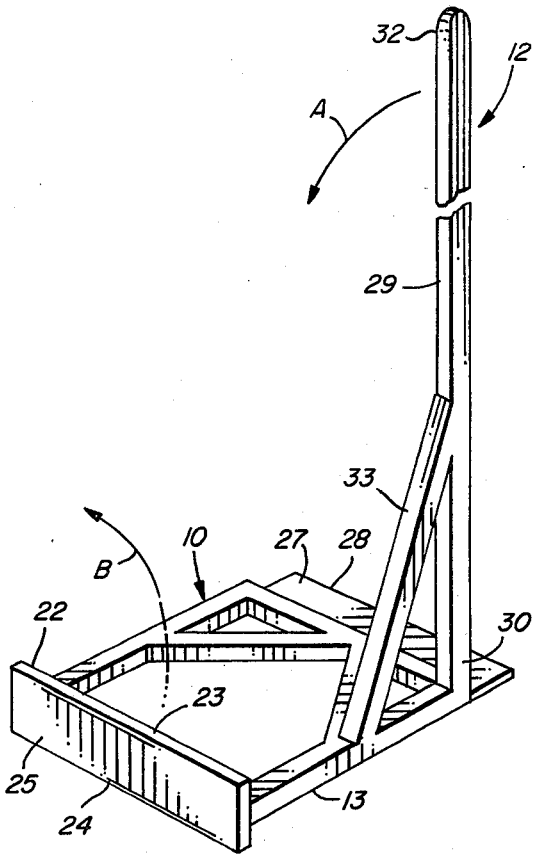
FIG. 1 is a perspective view of a jack embodying the teachings of the instant invention as it would appear in position for lifting a wheel of a two wheeled vehicle, the view being broken for purposes of illustration.
Figure 3:
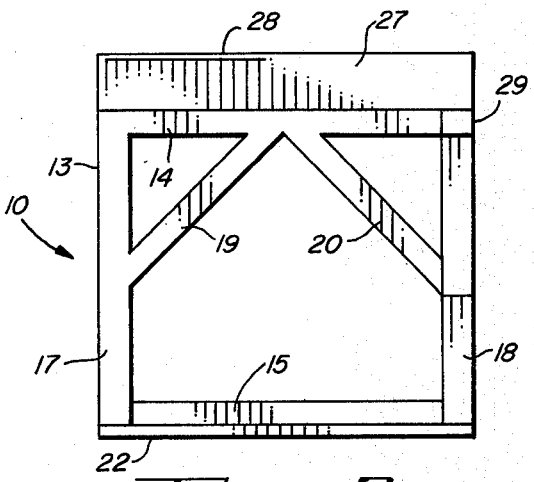
FIG. 3 is end elevation view taken from the left-hand end of the illustration of FIG. 2.

Turning now to the drawings in which like reference characters indicate the corresponding elements throughout the several views, attention is first directed to FIG. 1 which shows a jack, the lifting and supporting device of the instant invention, having lifting member and lever means, generally designated by the reference characters 10 and 12, respectively. As further seen in FIG. 3, lifting member 10 includes a generally rectangular lifting frame 13 formed by upper element 14, lower element 15, and side elements 17 and 18. Preferably, the several elements are structural steel joined by welding or other means common in the metal working art. Additional rigidity is imparted by diagonal braces 19 and 20. Frame 13 has a length which is equal to the length of lower element 15 plus side elements 17, 18, a height equal to the length of side element 17 and a thickness determined by the thickness of the members from which frame 13 is formed.

A foot 22, such as may be fabricated from steel plate, is secured along lower element 15. Foot 22, having longitudinal edges 23 and 24 and bottom surface 25, defines the lower edge of lifting member 10. Bottom surface 25 is generally perpendicular to the plane of frame 13. Contact element 27, preferrably fabricated of steel plate in general similarity to foot 22, extends upwardly from upper element 14. Longitudinally extending free edge 28 of contact element 27, defines the upper edge of lifting member 10.

In accordance with immediately preferred embodiment of the invention, lever means 12 is in the form of an elongate handle 29 having fixed end 30 secured to frame 13 and free end 32 which also may be considered to be the gripping end. For the stated purpose, free end 32 may be fitted with hand grip means of the type commercially available. Preferrably, the axis of handle 29 is substantially perpendicular to the plane of frame 13. Also, it is preferred that lever means 12 be secured to lifting member 10 in a position nearer the top edge than the lower edges. For purposes of illustration, fixed end 30 of handle 29 is shown as attached to the intersections of upper element 14 and side element 18. The attachment of handle 29 to frame 13 is reinforced by diagonal brace 33.

FIG. 1 illustrates the device of the instant invention as it would appear in the rest position prior to lifting a two wheeled vehicle. Lifting is accomplished by applying a force to handle 29 in the direction of arrowed line A. During movement, foot 22, specifically edge 24, functions as a fulcrum for rotation of lifting member 10 in the direction of arrowed line B. At the termination of movement, the device assumes the support position illustrated in FIG. 2. It is noted that although the device may be raised and supported upon lower element 15, foot 22 increases the bearing surface of lifting member 10 upon the ground. It is also pointed out that the distance between surface 25 and edge 28, the lower and upper edges, respectively, of lifting member 10, are spaced apart a distance greater than the distance between the frame of the vehicle to be lifted and the ground.

Figure 2:
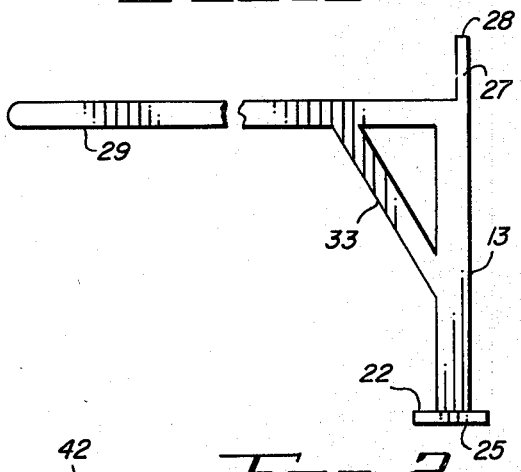
FIG. 2 is a side elevation view of the device of FIG. 1 as it would appear in the upright position when supporting the vehicle.
Figure 7:
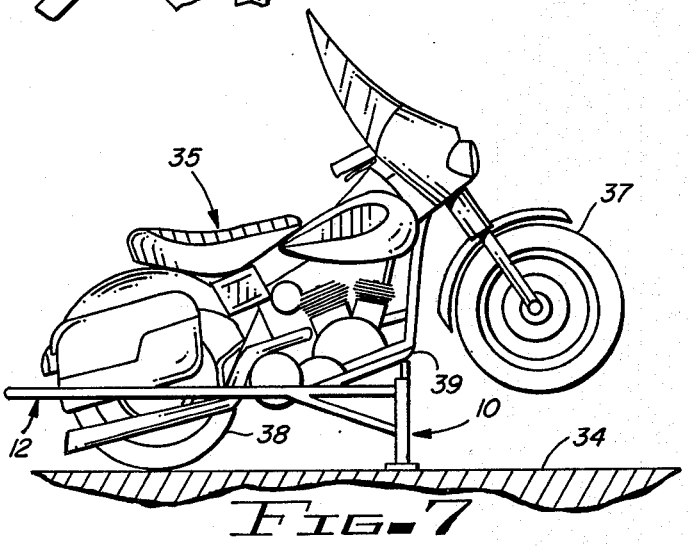
FIG. 7 is a side elevation view of a typical motorcycle as it would appear when supported by a jack embodying the principles of the instant invention.

Reference is now made to FIG. 7 which illustrates the device of the instant invention, in the support position shown in FIG. 2, as it would appear when bearing upon the ground 34 and supporting motorcycle 35. Motorcycle 35, which is intended to be illustratively typical of commercially available motorcycles, includes front wheel 37, rear wheel 38 and frame 39 intermediate wheels 37 and 38. In the immediate illustration, lifting member 10 is positioned under a forward portion of frame 39 thereby elevating front wheel 37. Placement of the device under a rearward portion of frame 39 will result in elevation of rear wheel 38 with front wheel 37 remaining upon the ground. Inherent stability is the result of the length of the ground contact portion of lifting member 10 which extends transverse of motorcycle 35. Additional stability is supported by the width of foot 22. To compensate for possible sliding movement between edge 28 and frame 39 during the lifting operation, edge 28 may be rounded.

Figure 4:
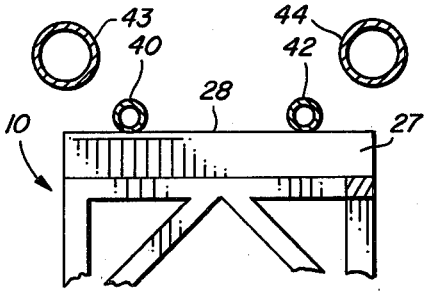
FIG. 4 is a semi-schematic illustration, including the upper portion of the drawing of FIG. 3, depicting the device in use for supporting a conventional motorcycle.

Typically, the conventional motorcycle frame in the area acted upon by the jack of the instant invention, is in the form of a pair of spaced apart tubular elements 40 and 42, as schematically represented in FIG. 4. Outboard of frame members 40 and 42, at a slightly raised elevation, are exhaust components 43 and 44. The exhaust components shown semischematically in cross-section, represent either exhaust pipes or mufflers. Frame elements 40 and 42, being spaced apart a distance of one foot or more, rest inherently stablely upon edge 28 which is substantially parallel to foot 22.

Figure 5:
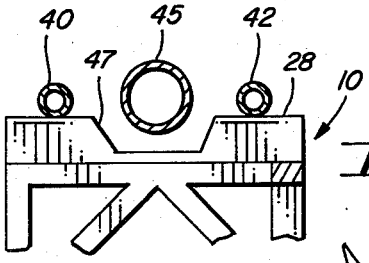
FIG. 5 is an illustration generally corresponding to the illustration of FIG. 4 and showing an alternate embodiment of the instant invention especially constructed for lifting and supporting an alternately configured conventional motorcycle.

FIG. 4 illustrates the typical exhaust component placement relative the frame members as adopted by numerous manufacturers. The position is especially desirable in cross-country type motorcycles where maximum ground clearance is desirable. FIG. 5 illustrates an alternate arrangement utilizing a single exhaust component 45 positioned intermediate and depending below, frame elements 40 and 42. With reference to FIG. 5, there is seen an alternate embodiment of the immediate invention including recess 47 formed in an intermediate location in edge 28, to accommodate exhaust component 45.

Figure 6:
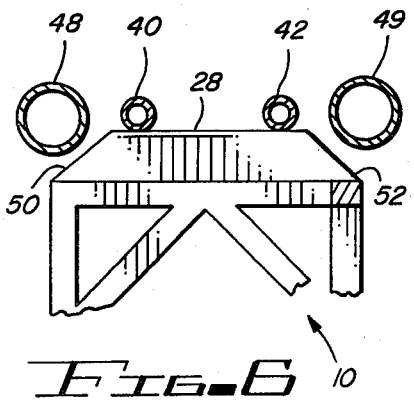
FIG. 6 is an illustration generally corresponding to the illustration of FIG. 4 and showing yet another embodiment of the instant invention especially adapted for use in lifting and supporting yet another style of motorcycle.

It is also known to position exhaust components outboard of the frame, as illustrated in FIG. 4, but having a portion thereof below the frame, as seen in FIG. 6. FIG. 6 illustrates yet another embodiment of the invention wherein the end portions 50 and 52 of edge 28 are angled downwardly to provide recesses for exhaust components 48 and 49. In each of the embodiments illustrated in FIGS. 4–6, edge 28 is substantially parallel to the level of ground 34.

Various modifications and changes to the embodiments herein chosen for purposes of illustration will readily occur to those skilled in the art. For example, while the device has been described as being preferrably a ferro-metallic weldment, other materials and methods of fabrication will occur to those skilled in the art. Further, the device may take other forms having varying visual appearance. It will be appreciated that lifting member 10 may be variously configured and that, lever means 12 may be secured to lifting member 10 differently than illustrated. Neither is special orientation considered limiting upon the scope of the invention. The terms upper and lower have been chosen for purposes of orientation in connection with the instant invention as it would appear in the support position. It is understood that the device will assume alternate positions. To the extent that such modifications and variations do not depart from the spirit of the invention, they are intended to be included within the scope thereof which is assessed only by a fair interpretation of the appended claims.

Having fully described and disclosed the present invention, and the alternate embodiments thereof, in such clear and concise terms as to enable those skilled in the art to understand and practice the same, the invention claimed is:

1. A jack for lifting and for supporting a motorcycle so that one of the two wheels of the motorcycle is elevated above a planar supporting surface while the other wheel contacts said surface, said motorcycle including a frame intermediate the two wheels, said frame having a minimum clearance between the frame and the supporting surface, said jack comprising:

a lifting frame defining a plane, said lifting frame having an upper element, a lower element, a length, a width and a height, a substantially planar contact element mounted on the upper element of the lifting frame so that the plane of the contact element is substantially parallel to the plane of the lifting frame and is adapted to establish substantially linear engagement with the underside of the frame of a motorcycle to be lifted and supported;

a foot having a substantially planar bottom surface, said foot being mounted on the lower element of the lifting frame so that the plane of the bottom surface of the foot is substantially perpendicular to the plane of the lifting frame; said bottom surface of the foot having a length substantially equal to the length of the lifting frame and a width substantially greater than the width of the frame; and elongate handle means having a substantially linear axis connected to the upper element of the lifting frame so that the axis of the handle means is substantially perpendicular to the plane of the lifting frame for rotating the contact element relative to the lower element of the lifting frame to lift and support a motorcycle, said motorcycle having one wheel engaging the support surface and its frame engaging the contact element; whereby, when the jack is supporting a motorcycle, the bottom surface of the foot is substantially in contact with the supporting surface and the handle means is spaced above the supporting surface and substantially parallel to said surface.

2. A jack as defined in claim 1 in which the width of the foot is less than said minimum clearance.

3. A jack as defined in claim 1 in which the overall height of the frame and the contact element is greater than said minimum clearance.

4. A jack as defined in claim 3 in which the lifting frame is substantially rectangular and further includes a pair of side elements.

5. The jack of claim 4 in which the handle means is adapted to rotate the plane of the lifting frame from being substantially horizontal to being substantially vertical to lift and support a motorcycle.

6. A jack as defined in claim 5 in which the contact element and the foot are each made of metal plate.

* * * * *